US006640675B1

(12) United States Patent
Chuang

(10) Patent No.: US 6,640,675 B1
(45) Date of Patent: Nov. 4, 2003

(54) TOOL KIT FOR BICYCLES

(76) Inventor: Louis Chuang, 7F-8, No. 20, Ta Lon Road, Taichung (TW)

( * ) Notice: Subject to any disclaimer, the term of this patent is extended or adjusted under 35 U.S.C. 154(b) by 0 days.

(21) Appl. No.: 10/230,940

(22) Filed: Aug. 29, 2002

(51) Int. Cl.[7] ..... B25G 1/08

(52) U.S. Cl. ..... 81/490; 81/177.4; 81/450; 7/167

(58) Field of Search ..... 81/490, 177.4, 81/125, 450, 177.8; 7/167, 168, 165

(56) References Cited

U.S. PATENT DOCUMENTS 2,518,139 A * 8/1950 Hallowell et al. ..... 279/75
5,329,834 A * 7/1994 Wong ..... 81/58.3
5,450,774 A * 9/1995 Chang ..... 81/440
5,802,936 A * 9/1998 Liu ..... 81/450
5,887,306 A * 3/1999 Huang ..... 7/165
5,918,513 A * 7/1999 Ho ..... 81/490
5,927,162 A * 7/1999 Huang ..... 81/177.8
6,032,332 A * 3/2000 Lin ..... 16/111.1
RE36,797 E * 8/2000 Eggert et al. ..... 81/438
6,243,902 B1 * 6/2001 Huang ..... 7/165
6,352,010 B1 * 3/2002 Giarritta et al. ..... 81/177.4
6,520,053 B2 * 2/2003 Liao ..... 81/177.9

* cited by examiner

*Primary Examiner*—Joseph J. Hail, III
*Assistant Examiner*—Hadi Shakeri
(74) *Attorney, Agent, or Firm*—Alan D. Kamrath; Rider Bennett, LLP.

(57) ABSTRACT

A tool kit includes a body, a socket and a positioning device. The body includes a first end, a second end and a chamber defined therein. The socket is used for holding a tool bit. The socket is pivotally connected with the first end of the body. The positioning device selectively can retain the socket in one of several positions relative to the body. The positioning device may include a boss formed on the first end of the body and a plurality of recesses defined in an internal face of the socket.

20 Claims, 7 Drawing Sheets

TOOL KIT FOR BICYCLES

BACKGROUND OF THE INVENTION

1. Field of Invention

The present invention relates to a tool kit for bicycles.

2. Related Prior Art

Taiwan Patent Publication No. 437546 discloses a tool kit for bicycles. It includes a body 10 with a small face and a large face. Several cavities 101 are defined in the small face of the body 10, and several hexagonal cavities 17 and 171 are defined in the large face of the body 10. A cover 132 is pivotally mounted on the small face of the body 10. The cover 132 can be moved between a closing position and an opening position. Several tool bits 131 can be stored in the cavities 101. In this case, the cover 132 is moved to the closing position so as to close the cavities 101, thus retaining the tool bits 131 in the cavities 101. The cover 132 can be moved to the opening position so as to open the cavities 101, thus allowing removal of the tool bits 131 from the cavities 101. The tool bits 131 can be inserted in the hexagonal cavities 17 and 171. Thus, a user can rotate the body 10 in order to rotate the tool bits 131 for driving a screw or bolt. However, the cover 132 causes trouble for removal of the tool bits 131 from the cavities 101. Furthermore, the cover 132 increases the width of the large face of the body 10 to an extent too large for a user to hold the cover 132 with comfort.

The present invention is therefore intended to obviate or at least alleviate the problems encountered in prior art.

SUMMARY OF INVENTION

It is the primary objective of the present invention to provide a tool kit including a body and a tool bit movable between various positions relative to the body.

According to the present invention, a tool kit includes a body, a socket and a positioning device. The body includes a first end, a second end and a chamber defined therein. The socket is used for holding a tool bit. The socket is pivotally connected with the first end of the body. The positioning device selectively can retain the socket in one of several positions relative to the body. The positioning device may include a boss formed on the first end of the body and a plurality of recesses defined in an internal face of the socket.

Other objects, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings wherein.

DETAILED DESCRIPTION OF PREFERRED EMBODIMENT

Figure 1:
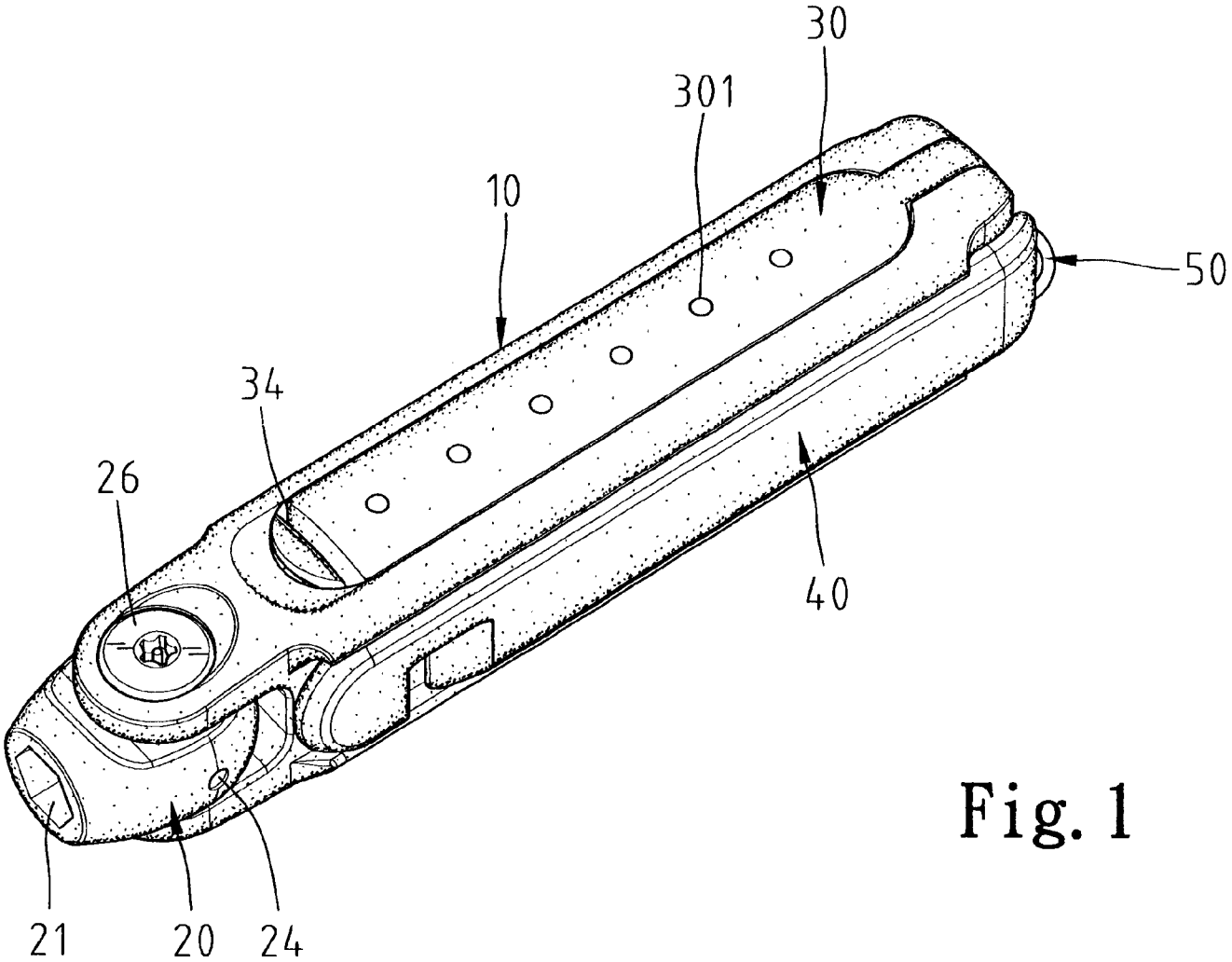
FIG. 1 is a perspective view of a tool kit according to a first embodiment of the present invention.
Figure 2:
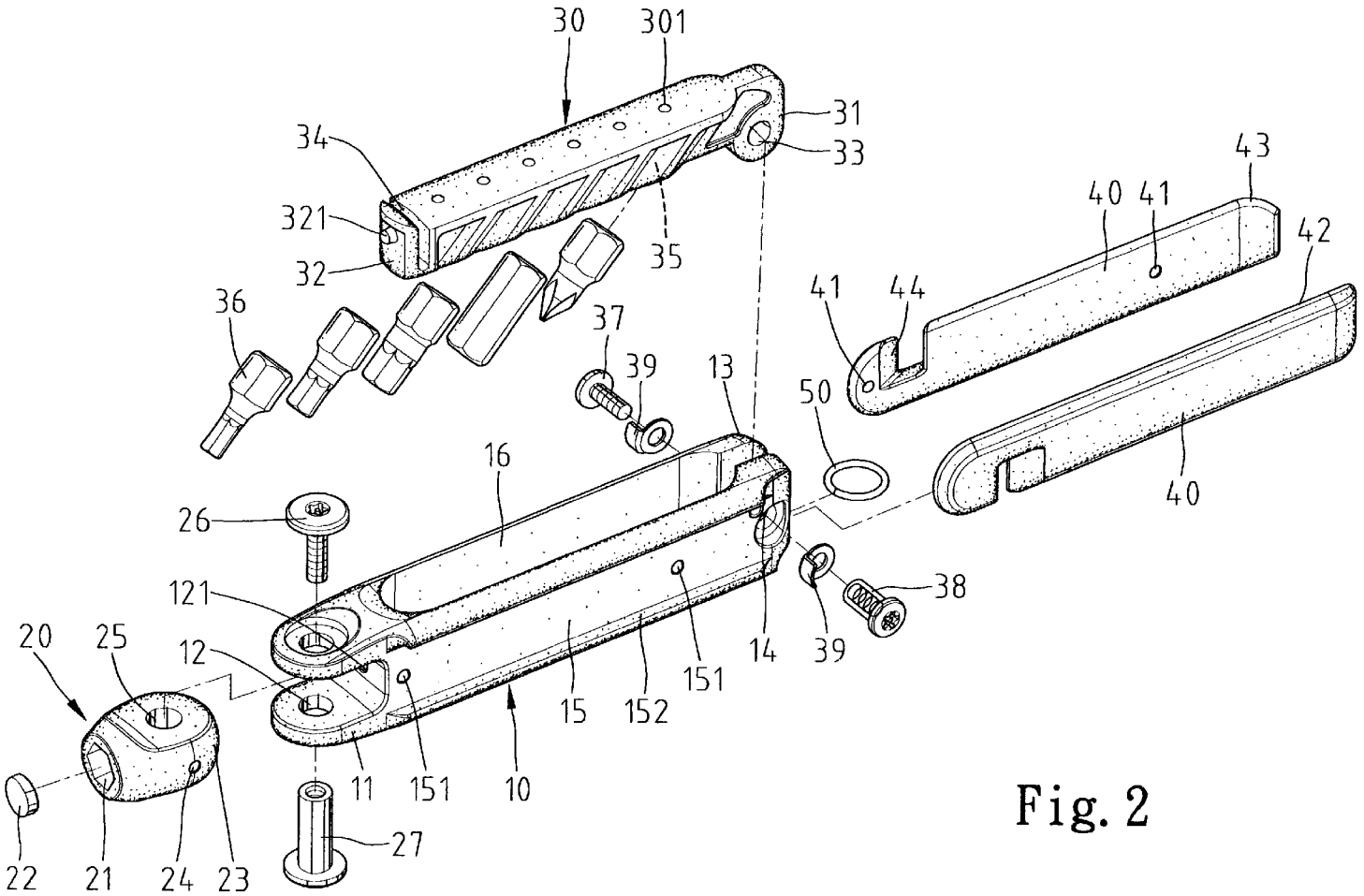
FIG. 2 is an exploded view of the tool kit according to the first embodiment of the present invention.
Figure 3:
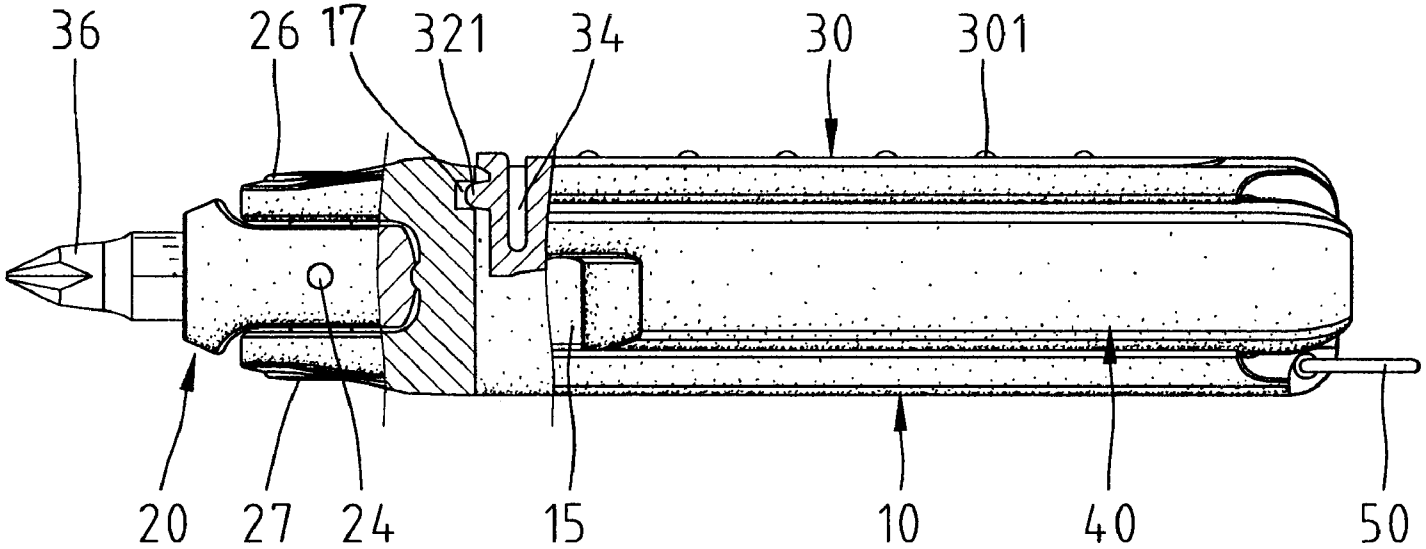
FIG. 3 is a cross-sectional view of the tool kit according to the first embodiment of the present invention.
Figure 4:
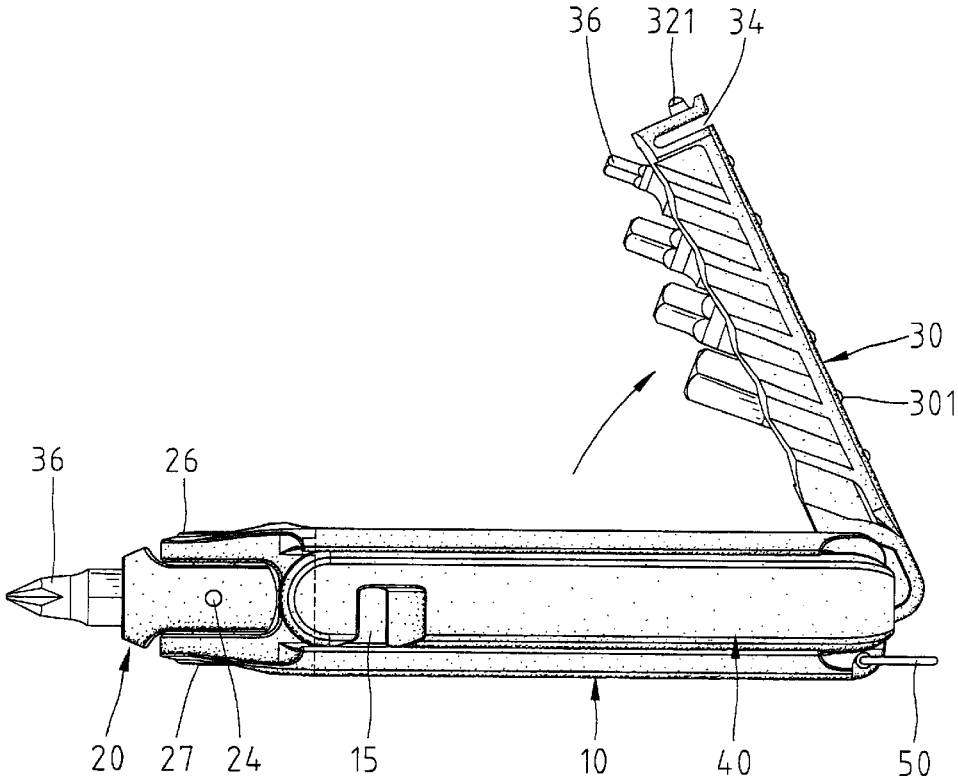
FIG. 4 is a side view of the tool kit in an extended position according to the first embodiment of the present invention.

Referring to FIGS. 1–4, according to the preferred embodiment of the present invention, a tool kit includes a body 10 with first and second ends and two opposite sides. Two ears 11 are formed at the first end of the body 10. An aperture 12 extends through each of the ears 11. A positioning boss 121 is formed at the first end of the body 10. The positioning boss 121 is formed with elasticity. Similarly, two ears 13 are formed at the second end of the body 10. An aperture 14 extends through each of the ears 13. A chamber 15 is defined between two flanges 152 extending on each of the opposite sides of the body 10. A plurality of bosses 151 is formed on each of the opposite sides of the body 10. A chamber 16 is defined in the body 10. As shown in FIG. 3, a recess 17 is defined in an internal face of the body 10 near the first end. The internal face of the body 10 is the face around the chamber 16.

A socket 20 includes first and second ends. A cavity 21 is defined in the first end of the socket 20 in order to receive a tool bit. A magnet 22 is fit in the cavity 21 in order to help retain a tool bit in the socket 20 by attraction. An arc-shaped face 23 is formed on the second end of the socket 20. Three recesses 24 are defined in the arch-shaped face 23. An aperture 25 extends through the socket 20. A bolt 26 includes a thread formed thereon. A tube 27 includes a thread formed on an internal face thereof In assembly, the socket 20 is positioned between the ears 11. The tube 27 is inserted through the apertures 12 and 25. The bolt 26 is engaged with the tube 27. Thus, the socket 20 is pivotally connected with the body 10. The positioning boss 121 can be inserted in the three recesses 24 so as to retain the body 10 in three positions relative to the socket 20.

A carrier 30 defines includes a first end 31 and a second end 32. An aperture 33 extends through the first end 31 of the carrier 30. A bolt 37 includes a thread formed on an internal face thereof. A tube 38 includes a thread formed on an internal face thereof. The carrier 30 defines a plurality of chambers 35 for receiving tool bits 36. A boss 321 is formed at the second end 32 of the carrier 30 for insertion in a recess defined in an internal face of the body 10. The carrier 30 includes a slit 34 defined therein near the second end 32 thereof. A number of bosses 301 are formed on a top face of the carrier 30.

In assembly, the first end 31 of the carrier 30 is located between the ears 13. The tube 38 is inserted through the apertures 14 and 33. The bolt 37 is engaged with the tube 38. Thus, the carrier 30 is pivotally connected with the body 10. Two washers 39 can be used to enhance the engagement of the bolt 37 with the tube 38. The carrier 30 can be moved between a concealed position shown in FIG. 1 and an extended position shown in FIG. 2.

The tool kit of the present invention includes two tools 40. Each of the tools 40 includes a plurality of recesses 41 defined in a side. Each of the tools 40 includes two edges 42 for engagement with the flanges 152 thus it can be inserted in one of the chambers 15. When one of the tools 40 is inserted in one of the chambers 15, the bosses 151 located in that chamber 15 are inserted in the recesses 41 of that tool 40, thus retaining that tool 40 in position on the body 10.

In the preferred embodiment, each of the tools 40 is a combination of a crowbar with a spanner used to remove a tire from a rim of a wheel. Like a crowbar, each of the crowbars tools 40 includes a bent end 43. Like a spanner, each of the tools 40 defines a cutout 44 for receiving a nozzle attached to a rim of a wheel.

A ring 50 is attached to the second end of the body 10 so that the tool kit can be carried easily.

Figure 5:
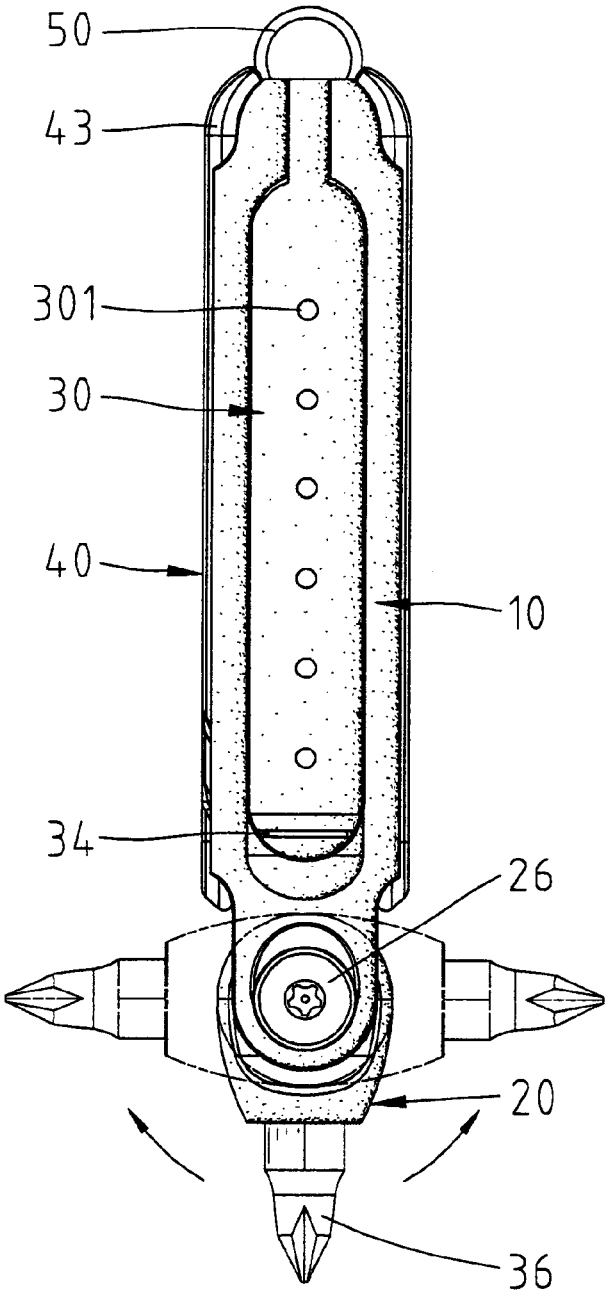
FIG. 5 is a top view of the tool kit according to the first embodiment of the present invention.

Referring to FIG. 5, the socket 20 can be pivoted relative to the body 10. The socket 20 can be retained in three positions relative to the body 10 due to insertion of the positioning boss 121 in the recesses 24. When the socket 20 and the tool bit 36 inserted therein are at a right angle from the body 10, the tool kit is suitable for providing a large torque for driving a screw or bolt. When the socket 20 and the tool bit 36 inserted therein are in line with the body 10, the tool kit is suitable for fast rotation of a screw or bolt.

Figure 6:
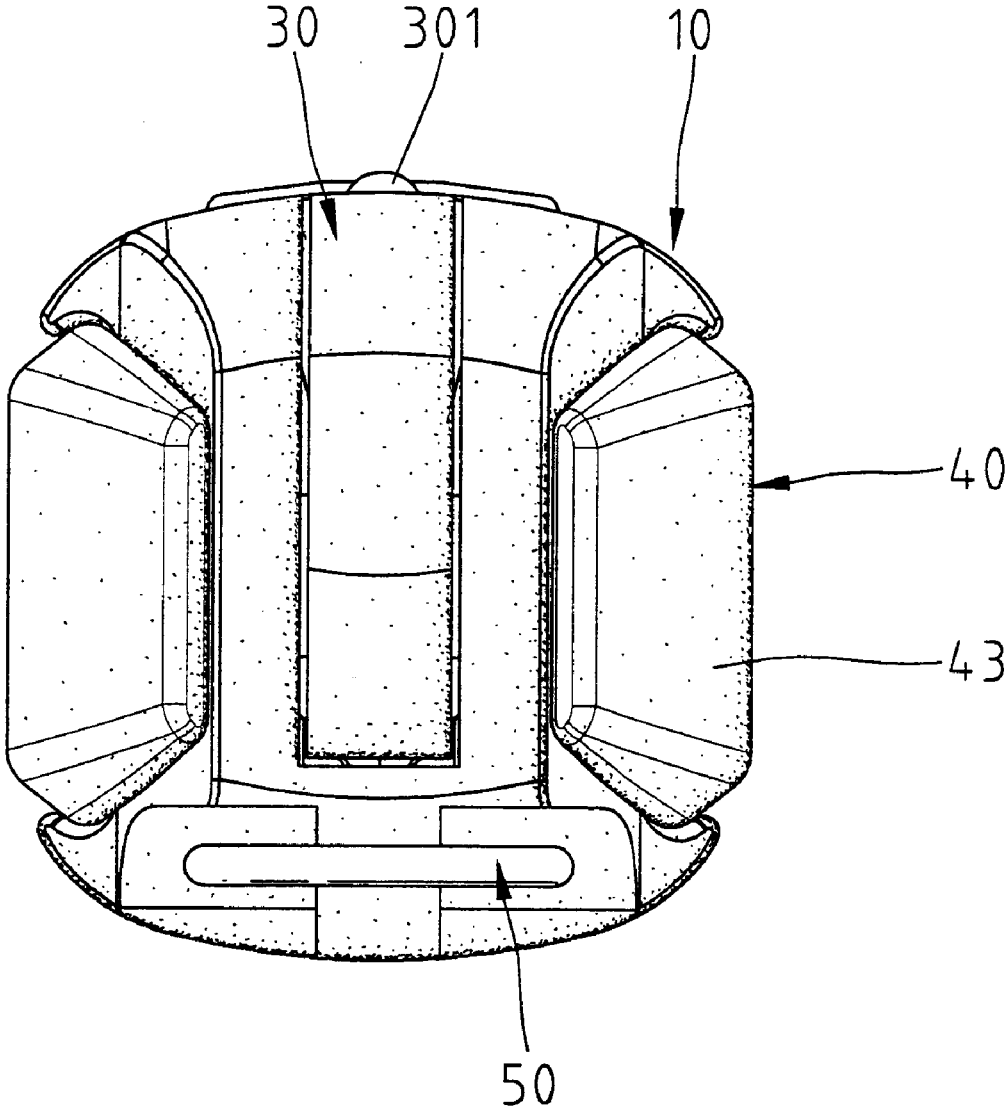
FIG. 6 is a rear view of the tool kit according to the first embodiment of the present invention.

Referring to FIG. 6, the tools 40 are in flush with the body 10 so that the tools 40 cannot easily be removed from the body 10 by mistake.

Figure 7:
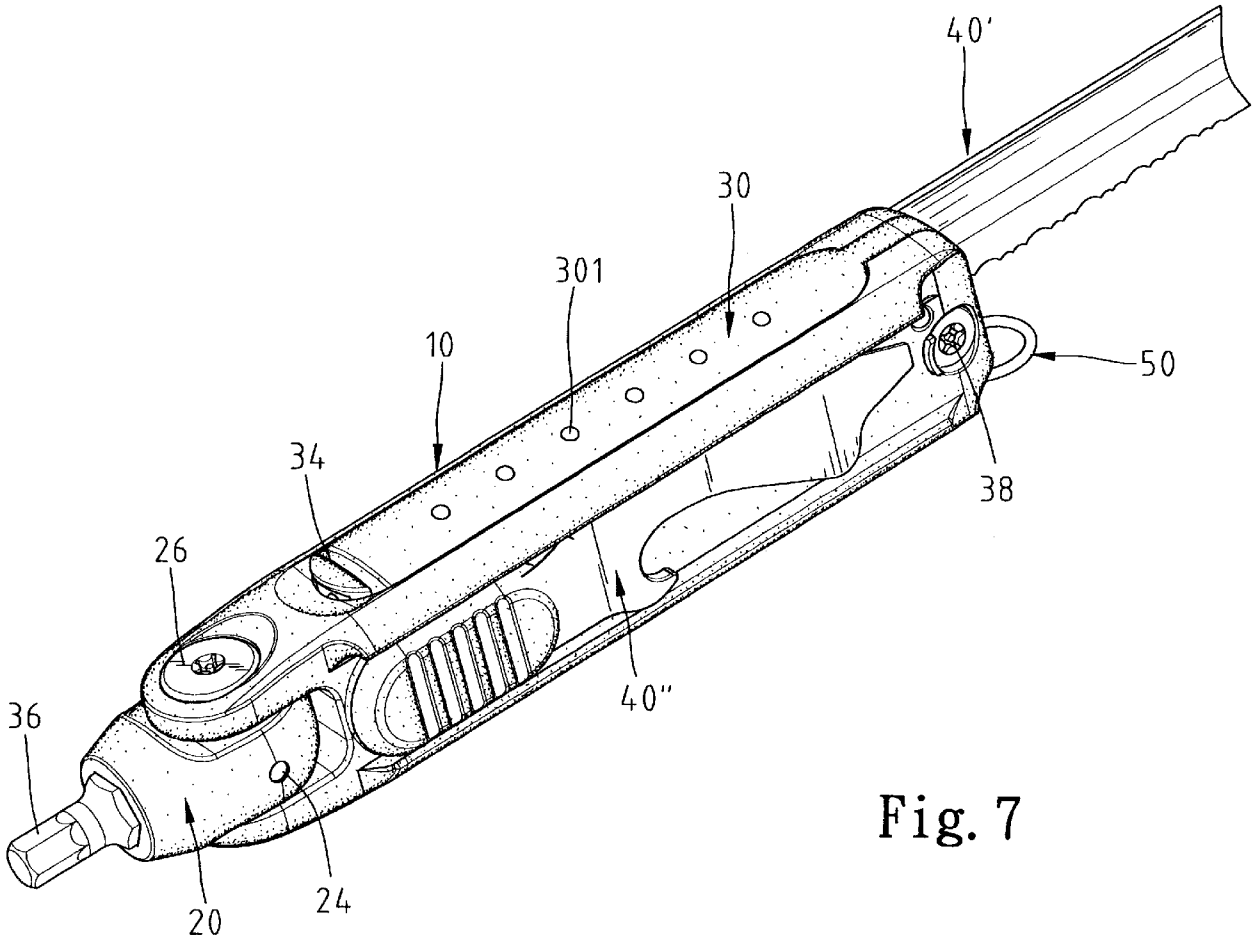
FIG. 7 is a perspective view of the tool kit according to a second embodiment of the present invention.

FIG. 7 shows a tool kit according to a second embodiment of the present invention. In the second embodiment, a saw 40' and a can opener 40" are used instead of the tools 40.

The present invention has been described through detailed illustration of the preferred embodiment. Those skilled in the art can derive many variations from the preferred embodiment without departing from the scope of the present invention. Therefore, the preferred embodiment shall not limit the scope of the present invention. The scope of the present invention is defined in the attached claims.

What is claimed is:

1. A tool kit including:

a body including a chamber defined therein, two flanges formed thereon and at least one boss formed thereon between the two flanges, with the body and the two flanges defining a cavity for receiving a tool slideably attachable to the body for storage and removable from the body for use, the tool including two edges for engagement with the flanges and at least one recess defined therein for receiving the at least one boss so as to keep the tool in position on the body;

a socket for holding a tool bit, the socket being pivotally connected with the body;

a positioning device for selectively retaining the socket in one of several positions relative to the body; and a carrier for holding tool bits, the carrier being pivotally connected with the body between a concealed position in the chamber of the body and an extended position outside the chamber of the body.

2. The tool kit according to claim 1 wherein the positioning device includes a boss formed on the body and a plurality of recesses defined in an external face of the socket.

3. The tool kit according to claim 1 wherein the body includes two ears on which the socket is pivotally mounted.

4. The tool kit according to claim 3 including a bolt inserted in an aperture extending through each of the ears and an aperture extending through the socket.

5. The tool kit according to claim 3 including a tube inserted in an aperture extending through each of the ears and an aperture extending through the socket and a bolt inserted in the tube.

6. The tool kit according to claim 5 wherein the tube includes a thread formed on an internal face, and the bolt includes a thread formed thereon for engagement with that of the tube.

7. The tool kit according to claim 1 including a magnet fit in the socket.

8. The tool kit according to claim 1 wherein the carrier defines a plurality of chambers for receiving tool bits.

9. The tool kit according to claim 1 wherein the carrier includes a boss formed thereon, and the body includes a recess defined in an internal face in order to receive the boss formed on the carrier so as to retain the carrier in the concealed position.

10. The tool kit according to claim 9 wherein the carrier defines a slit near the boss thereof so that the carrier is movable in a wider range.

11. The tool kit according to claim 1 wherein the body includes two ears on which the carrier is pivotally mounted.

12. The tool kit according to claim 11 including a bolt inserted in an aperture extending through each of the ears and an aperture extending through the carrier.

13. The tool kit according to claim 11 including a tube inserted in an aperture extending through each of the ears and an aperture extending through the carrier and a bolt inserted in the tube.

14. The tool kit according to claim 13 wherein the tube includes a thread formed on an internal face, and the bolt includes a thread formed thereon for engagement with that of the tube.

15. A tool kit including:

a body including a first end, a second end and a chamber defined therein;

a socket for holding a tool bit, the socket being pivotally connected with the first end of the body on a first axis; and a carrier for holding tool bits, the carrier including a first end and a second end, wherein the first end of the carrier is pivotally connected with the second end of the body on a second axis having perpendicular orientation to the first axis so that the carrier can be moved between a concealed position in the chamber of the body and an extended position outside the chamber of the body.

16. The tool kit according to claim 15 wherein the at least one tool is a crowbar.

17. The tool kit according to claim 15 wherein the at least one tool is a saw.

18. The tool kit according to claim 15 wherein the at least one tool is a can opener.

19. The tool kit according to claim 1 wherein the socket is pivotally connected on a first axis of a first end of the body, the carrier is pivotally connected on a second axis on a second end of the body, and wherein the first axis has an orientation perpendicular to the second axis.

20. The tool kit according to claim 1 wherein the cavity is disposed on a first side of the body and a second cavity is formed by a third flange and a fourth flange formed on an opposing side of the body.

* * * * *